US005329110A

United States Patent [19]

Shimabukuro et al.

[11] Patent Number: 5,329,110

[45] Date of Patent: Jul. 12, 1994

[54] METHOD OF FABRICATING A MICROELECTRONIC PHOTOMULTIPLER DEVICE WITH INTEGRATED CIRCUITRY

[75] Inventors: Randy L. Shimabukuro; Stephen D. Russell, both of San Diego, Calif.

[73] Assignee: The United States of America as represented by the Secretary of the Navy, Washington, D.C.

[21] Appl. No.: 156,192

[22] Filed: Nov. 22, 1993

Related U.S. Application Data

[62] Division of Ser. No. 908,692, Jul. 1, 1992, Pat. No. 5,264,693.

[51] Int. Cl.[5] ..... H01J 39/06

[52] U.S. Cl. ..... 250/207; 313/533; 437/927

[58] Field of Search ..... 250/207, 214 VT, 208.1; 313/103 R, 533; 437/927, 2, 3, 4, 5,

[56] References Cited

U.S. PATENT DOCUMENTS

| | | | |
|---|---|---|---|
| 4,115,719 | 9/1978 | Catanese et al. | 313/105 R |
| 4,147,929 | 4/1979 | Taylor | 250/207 |
| 4,148,050 | 4/1979 | Maier, Jr. | 257/436 |
| 4,534,099 | 8/1985 | Howe | 437/2 |
| 4,557,037 | 12/1985 | Hanoka et al. | 437/2 |
| 4,758,734 | 7/1988 | Uchida et al. | 250/208.1 |
| 4,826,777 | 5/1989 | Ondris | 437/2 |
| 4,925,805 | 5/1990 | Ommen et al. | 437/927 X |
| 4,990,827 | 2/1991 | Ehrfeld et al. | 313/533 |
| 5,098,856 | 3/1992 | Beyer et al. | 437/927 X |
| 5,264,693 | 11/1993 | Shimabukuro et al. | 250/207 |

*Primary Examiner*—David C. Nelms
*Assistant Examiner*—John R. Lee
*Attorney, Agent, or Firm*—Harvey Fendelman; Thomas Glenn Keough

[57] ABSTRACT

A microelectronic photomultiplier device is fabricated by discrete procedures to provide a photocathode-anode and dynode chain arrangement which is analogous in operation to conventional photomultiplier tubes. This microelectronic photomultiplier device provides for low level photon detection and realizes the advantages of high reliability, small size and fast response, plus lower cost, weight and power consumption compared to conventional photomultiplier tubes. In addition, the fabrication on an SOI substrate permits integration of logic and control circuitry with detectors. The insulating substrate also permits the integration of an on-chip high voltage supply and may easily be extended to a plurality of detectors offering improved performance and design flexibility.

7 Claims, 5 Drawing Sheets

20
21
22¹
22²
22³
22⁴
22ᴺ
23
24
25
31

METHOD OF FABRICATING A MICROELECTRONIC PHOTOMULTIPLER DEVICE WITH INTEGRATED CIRCUITRY

STATEMENT OF GOVERNMENT INTEREST

The invention described herein may be manufactured and used by or for the Government of the United States of America for governmental purposes without the payment of any royalties thereon or therefor.

This is a division of application Ser. No. 07/908,692, filed Jul. 1, 1992, now U.S. Pat. No. 5,264,693.

BACKGROUND OF THE INVENTION

A large majority of light detection applications today rely on low cost, lightweight, high performance integrated circuit devices, such as, CCD's (charge coupled devices), p-i-n (p-type semiconductor:insulator:n-type semiconductor) and avalanche photodiodes. However for applications which require detection of very small signals with low signal to noise ratios (SNR), the vacuum photomultiplier tube is still superior to these integrated circuit type photodetectors.

A schematic of a conventional photomultiplier is shown in FIG. 1. It consists of a photocathode (C) and a series of electrodes called "dynodes" 1–8. Each dynode is biased at a progressively higher voltage than the cathode. Typically, the voltage increase at each dynode is about 100 volts.

Photons striking the photocathode generate electrons via the photoelectric effect. These electrons are accelerated by the field between electrodes and strike the surface of the first dynode with an energy equal to the accelerating voltage. Each primary electron generates several secondary electrons in the collision with the surface of the first dynode. These secondary electrons are accelerated towards the second dynode and the process is repeated. After passing through about eight stages of dynodes, the single photoelectron will have grown to a packet of $10^5$ or $10^6$ electrons. The last electrode, labeled A, is the anode which collects the electrons in the final stage. The anode signal is then fed into appropriate external signal processing electronics. Two types of photocathodes that have been used are the opaque photocathode and the semitransparent photocathode which only partly absorb incident light and are schematically depicted in FIGS. 2 and 3, respectively. The spectral sensitivity of the photocathode is determined by its work function, therefore it is possible to choose a photocathode material to match a specific application.

Some of the disadvantages of conventional photomultipliers relative to integrated photodetectors are their large size and weight, high costs, and large power consumption. Furthermore, external electronics are normally required to obtain useful signal information. This requires additional interconnections, which increases system complexity and reliability. As a consequence, some modern applications, e.g. remote sensing, have been prohibited.

Thus, there is a continuing need in the state of the art for a microelectronic form of a photomultiplier tube which is designed to combine the desirable features of conventional photomultiplier tubes with the lightweight, low-power, low-cost advantages of an integrated circuit device.

SUMMARY OF THE INVENTION

The present invention is directed to providing methods of and apparatuses for fabricating a microelectronic photomultiplier device responsive to at least one impinging wavelength. One method and apparatus calls for the providing of a transparent insulating substrate and depositing appropriately configured dynodes and one anode in a juxtaposed arrangement on the transparent insulating substrate to allow a depositing of a photocathode adjacent the dynodes on the transparent insulating substrate. The photocathode has the property to generate a representative electron emission in response to the at least one impinging wavelength. The depositing of a volume of sacrificial material sufficient to cover the dynodes, the anode and the photocathode and the depositing of a polysilicon cap over the sacrificial material volume with a providing of a hole through the polysilicon cap to be in communication with the sacrificial material volume allows the introducing of an etchant having the property to etch-away the sacrificial material and further having the property not to etch away the materials of the polysilicon cap, the dynodes, the anode and the photocathode. The etching-away of the sacrificial material volume produces a cavity inside the polysilicon cap that contains the dynodes, the anode and the photocathode so that an evacuating of any gas that may have been in the cavity produces an evacuated cavity-chamber to enable a sealing of the hole in the polysilicon cap in a vacuum thereby forming an evacuated cavity-chamber containing the dynodes, the anode and the photocathode to thereby provide the microelectronic photomultiplier device.

Another embodiment responsive to at least one impinging wavelength calls for the providing of two insulating substrates, at least one of which being transparent to the at least one impinging wavelength for the depositing of appropriately arranged dynodes on each of the insulating substrates to have a staggered alternating pattern therebetween and one adjacent anode on one insulating substrate and the depositing of a photocathode on one of said insulating substrates adjacent the dynodes on a transparent insulating substrate. The photocathode has the property to generate a representative electron emission in response to the at least one impinging wavelength. Forming a spacer between the substrates to have a peripherally encircling definition about the deposited dynodes, anode and photocathode defines a chamber which calls for the evacuating of any gas that may have been in the chamber to produce a vacuum chamber. Affixing the spacer to the substrates defines the vacuum chamber therein which contains the dynodes, the anode and the photocathode to thereby provide the microelectronic photomultiplier device.

In the embodiments herein the spacing between an adjacent photocathode, dynodes and/or anode is in the range of from 1 micron to about 10 millimeters.

An object of the invention is to provide a photomultiplier device which is in microelectronic form to gain all the advantages typical of microelectronics.

Another object is to provide a microelectronic photomultiplier device being smaller in size, lower in cost, more reliable, less in weight and with less power consumption as compared to a conventional photomultiplier tube.

Another object of the invention is to provide a microelectronic photomultiplier fabricated in an SOI type technology which is compatible with microelectronic circuits to allow logic and control circuitry to be integrated with the photomultiplier detectors.

Yet another object of the invention is to provide a microelectronic photomultiplier capable of being fabricated in an integrated circuit configuration to allow the device to be integrated with high voltage power supplies.

Another object is to provide a microelectronic photomultiplier capable of being fabricated in a plurality of detectors to offer improved performance and design flexibility.

Yet another object is to provide a microelectronic photomultiplier being of small size to result in faster photoresponse characteristics as compared to traditional photomultiplier tubes.

These and other objects of the invention will become more readily apparent from the ensuing specification and claims when taken in conjunction with the appended drawings.

DISCLOSURE OF THE PREFERRED EMBODIMENT

The microelectronic photomultiplier device of this inventive concept is a low level photon detector using a photocathode, anode and dynode chain arrangement. Operation of the microelectronic photomultiplier device is analogous to the operation of a conventional photomultiplier tube as referred to above. Photons striking the photocathode generate electrons, an electron emission, via the photoelectric effect. These electrons are accelerated by the field between electrodes and strike the surface of the first dynode with an energy equal to the accelerating voltage. Each primary electron generates several secondary electrons in the collision with the surface of the first dynode. These secondary electrons are accelerated towards the second dynode and the process is repeated to where the electrons are collected at an anode. Each dynode is biased at a progressively higher voltage than the cathode. Typically, the voltage increase (bias) at each dynode is about 100 volts. Thus, each dynode has the property to amplify the electron emission with a progressively increased applied voltage bias and the anode has the property to collect the amplified electron emissions.

After passing through about eight stages of dynodes, the single photoelectron will have grown to a packet of $10^5$ or $10^6$ electrons. The last electrode is the anode which collects the amplified electron emission in the final stage. The anode signal is then fed into appropriate signal processing electronics which, in this inventive concept can be integrated on-chip. The spectral sensitivity of the photocathode is determined by its work function, therefore it is possible to choose a photocathode material to match a specific application.

The spread in transit time for a photomultiplier can be approximated by the expression:

$$\Delta t_n = -(2mW_n/e^2E_0^2)^{\frac{1}{2}},$$

where m = the mass of an electron, e = the charge of an electron, $E_0$ = the electric field strength, and W = the energy component normal to the cathode.

A microelectronic photomultiplier will operate at significantly higher ranges of $E_0$ due to the reduced size of its components. The smaller spread in transit time will yield a faster device. The microelectronic embodiment of this inventive concept additionally possesses the advantages of higher reliability and smaller size as compared to the conventional photomultiplier tube. Additional advantageous features of this inventive concept are that the fabrication on an SOI substrate permits integration of logic, control circuitry and signal processing with the detectors. Such an arrangement on an insulating substrate also allows for the integration of an on-chip high voltage supply and lends itself to the fabrication of a plurality of detectors with still greater improvements in performance and design flexibility.

Figure 1:
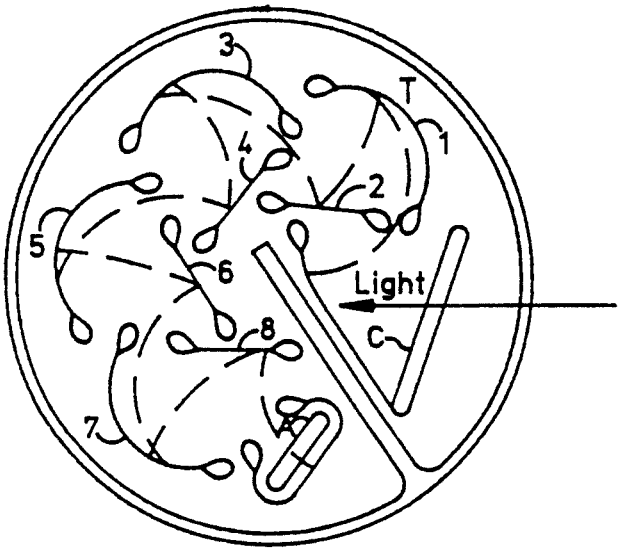
PRIOR ART FIG. 1
FIG. 1 depicts a conventional prior art photomultiplier tube.
Figure 2:
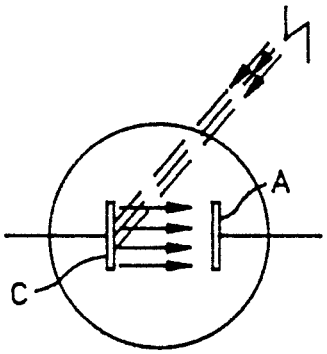
PRIOR ART FIG. 2
FIG. 2 shows a prior art opaque photocathode.
Figure 3:
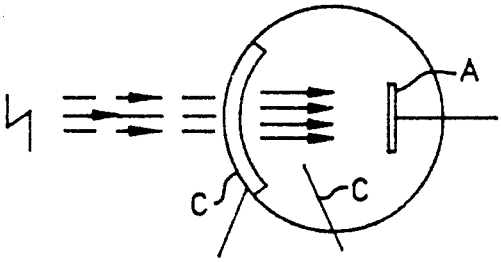
PRIOR ART FIG. 3
FIG. 3 depicts a prior art semitransparent photocathode.

This inventive concept is better appreciated from several ensuing fabrication techniques which provide all of the capabilities of the conventional photomultiplier tube as shown in FIG. 1. The methods for fabricating the microelectronic photomultiplier device can embrace the two types of photocathodes shown in FIGS. 2 and 3, which are for the partial absorption of incident light in the semi-transparent photocathode variety and the more complete absorption of incident light in the opaque photocathode, respectively.

Referring to FIGS. 4A, 4B, 4C, 4D, 4E and 4F one method for fabricating microelectronic photomultiplier devices in accordance with this inventive concept relies on the use of microlithography/micromachining techniques to form the associated structure and then enclosing the structure in a cavity and sealing it under vacuum conditions. A microelectronic photomultiplier device 10 has a transparent insulating substrate 11 which may have associated electronic circuitry (not shown) already fabricated on adjacent portions of the substrate. The associated electronic circuitry can be a variety of components such as thin film transistors (TFT) or CMOS/SOS and can also include electrical conductors for biasing potentials and the like. The transparent insulating substrate may be fabricated from any one of numerous suitable materials such as sapphire, glass, fused quartz or similar materials which are amenable with the ensuing fabrication steps and device requirements.

Figure 4A:
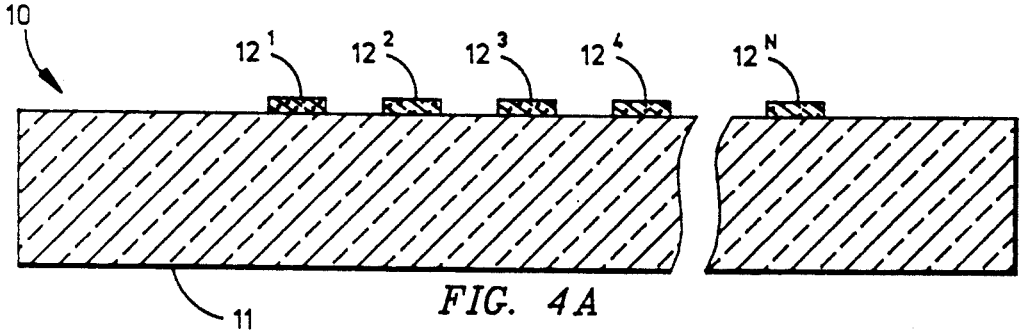
FIGS. 4A through 4F depict a method of fabricating one embodiment of a microelectronic photomultiplier device.
Figure 4B:
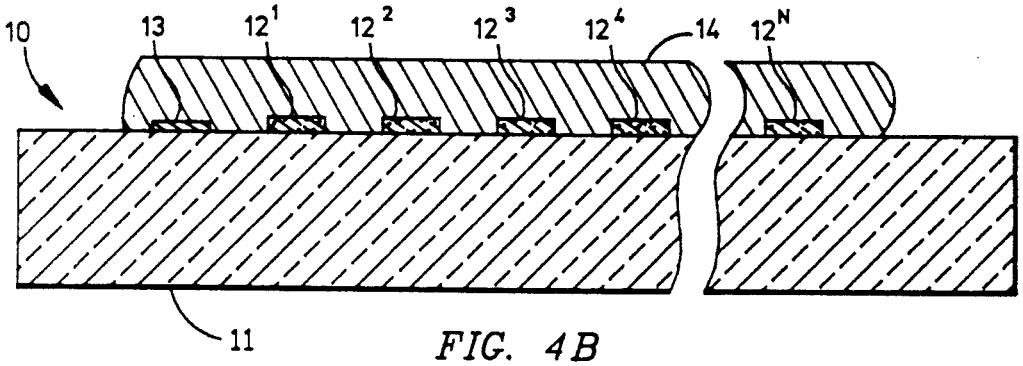

Looking now to FIG. 4A a plurality of juxtaposed dynodes $\mathbf{12}^1$, $\mathbf{12}^2$, $\mathbf{12}^3$, $\mathbf{12}^4$, . . . $\mathbf{12}^N$ are provided. The dynodes are photolithographically patterned and deposited and appropriately etched in a prearranged juxtaposed pattern on the surface of transparent insulating substrate 11. Dynode $\mathbf{12}^N$ also may be referred to as an anode $\mathbf{12}^N$ and will function as the anode in this embodiment of the microelectronic photomultiplier device. These fabrication steps are in accordance with those well established in the art and the material from which the dynodes and anode are fabricated can be any one of a number of suitable materials such as doped polysilicon, aluminum or other materials determined by the job at hand.

A photocathode 13 is photolithographically patterned and deposited with an appropriate etch on the surface of transparent insulating substrate 11 and usually follows the dynode formation. The material selection for the photocathode is a function of the desired wavelength of detection and efficiency requirements for a generation of a representative electron emission for a particular application.

A suitable sacrificial material, such as silicon dioxide, is deposited over the dynodes and photocathode on the transparent insulating substrate to form a structure 14 for defining a desired cavity that will be formed in the finished microelectronic photomultiplier device. The deposited sacrificial oxide may be photolithographically patterned and etched to define the dimensions of structure 14 which forms the dimensions of the desired cavity, see FIG. 4B.

Figure 4C:
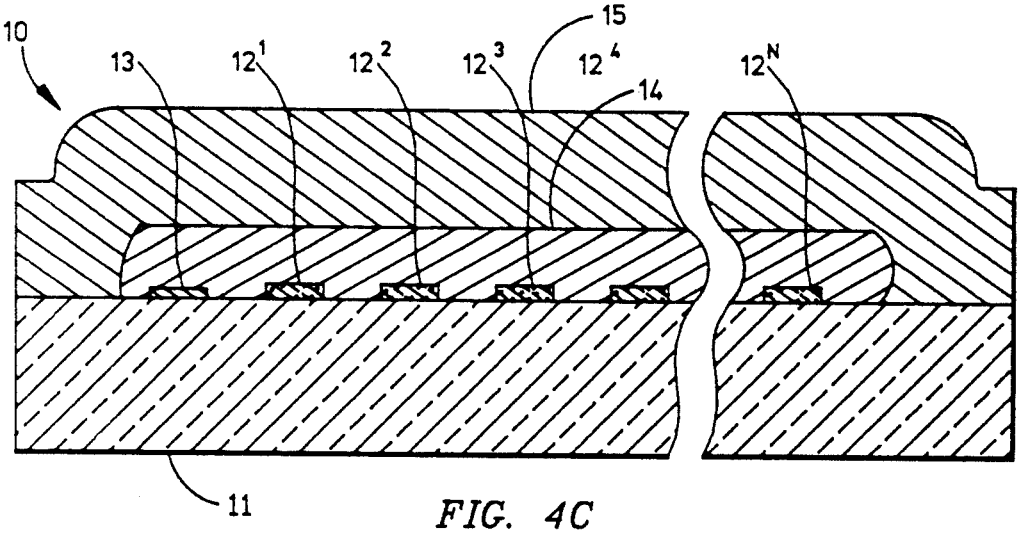

After the particularly configured sacrificial oxide structure 14 is formed, a polysilicon cap 15 is deposited thereover in roughly the configuration shown in FIG. 4C. Next, polysilicon cap 15 may be patterned and at least one etch hole 16 is provided to allow the access of an etchant (for example, hydrofluoric acid which selectively etches silicon dioxide) to the sacrificial material structure 14 (in this case silicon dioxide).

The appropriate etchant that is introduced to etch-away the sacrificial material does not react with the photocathode, dynodes, anode or transparent insulating substrate and is selected in accordance with a job at hand. The suitable etchant is introduced through hole 16 and sacrificial material structure 14 is etched out, leaving a cavity 14', see FIG. 4D.

Figure 4D:
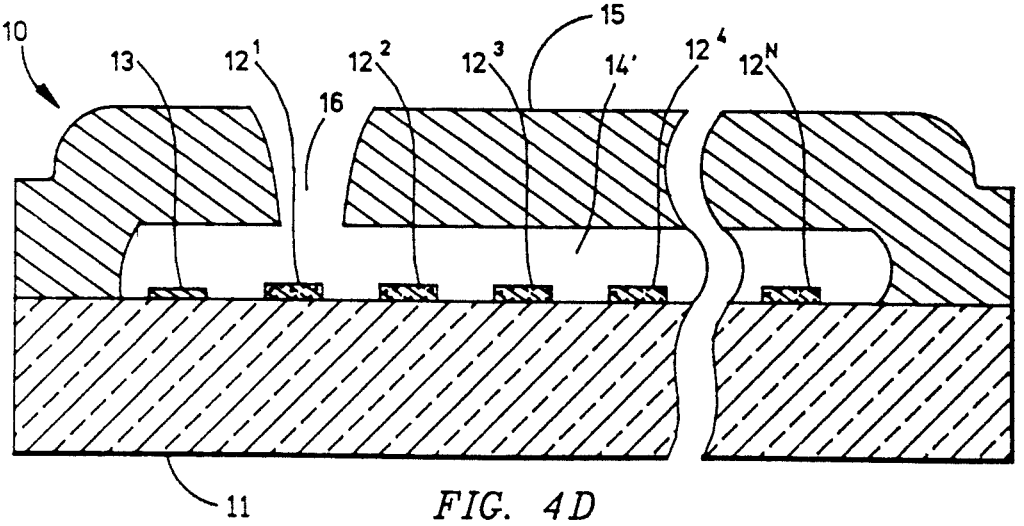
Figure 4E:
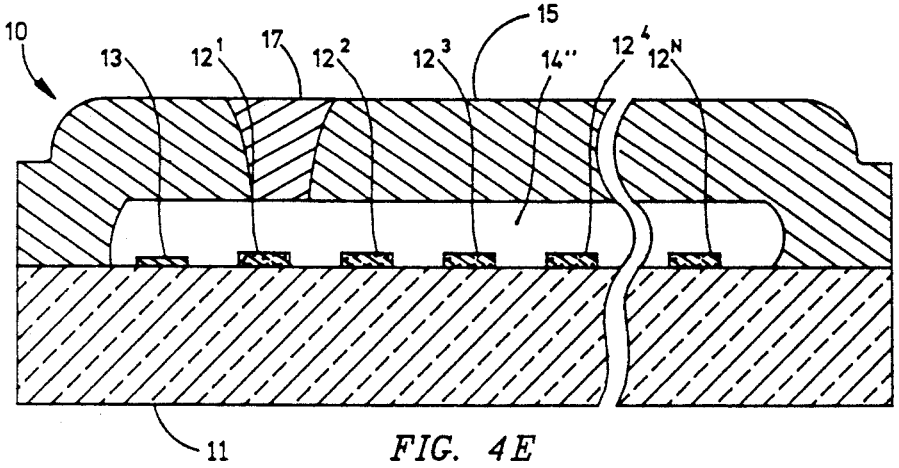
Figure 4F:
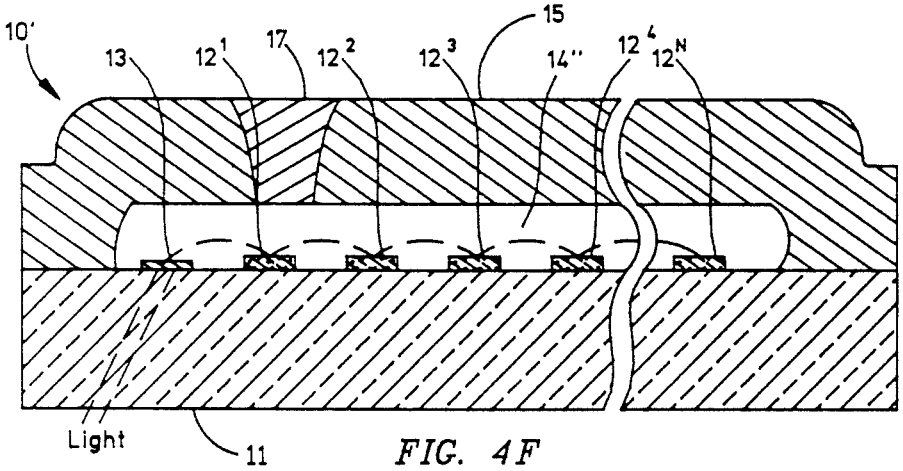

The structure shown in FIG. 4D is placed in a vacuum chamber where substantially all gases are evacuated from cavity 14'. A plug 17 is applied by an appropriate method, such as deposition, bonding or laser reflow, to seal an evacuated cavity-chamber 14'', note FIG. 4E. If laser reflow is selected, the laser reflow requires the application of light in sufficient fluence (nominally pulses of about 25 nsec duration with greater than 0.5 $J/cm^2$) to melt the polysilicon cap and effect a reflow and resolidification to enclose the opening. The completed microelectronic photomultiplier device 10' is schematically depicted in operation in FIG. 4F with a desired radiation, such as light, impinging on photocathode 13 with subsequent electron transport and amplification in vacuum cavity 14'' along the dynode chain $12^1$–$12^N$. The photocathode, interposed dynodes and anode are appropriately electronically coupled to suitable circuitry and bias sources to assure that responsive output signals are created in response to the impinging light and are interconnected to other processing circuitry.

The optimum thicknesses for photocathode 13 and dynodes $12^1 \ldots 12^N$ will depend upon the material used and upon the desired detection wavelength but shall be in the range from 1 nm to less than or to 500 microns. Their lengths (measured in the direction of current flow between cathode and anode) will be in the range from 1 micron to about 10 millimeters. Their widths (measured in the direction perpendicular to current flow between cathode and anode) shall be more than twice their lengths. The spacing between an adjacent photocathode, dynodes and/or anode is in the range of from 1 micron to about 10 millimeters.

Figure 5A:
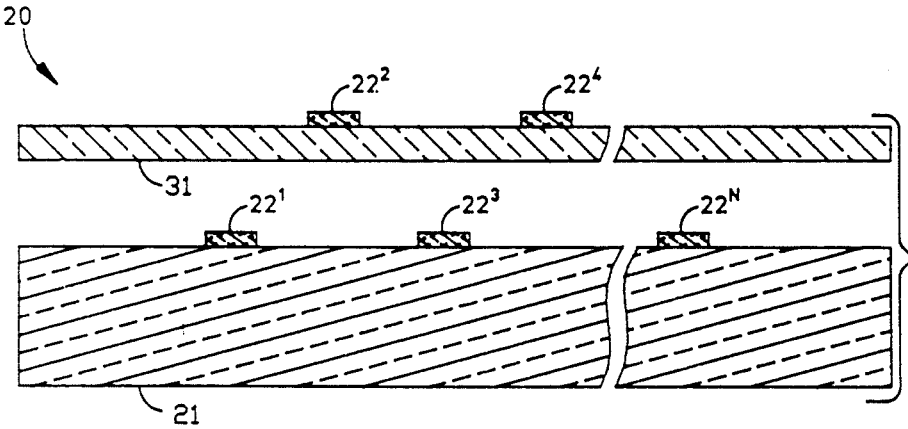
FIGS. 5A through 5E depict a method of fabricating another embodiment of a microelectronic photomultiplier device.

Another method configuration of a microelectronic photomultiplier device 20 is set forth in FIGS. 5A, 5B, 5C, 5D and 5E. In this embodiment FIG. 5A shows two insulating substrates, bottom substrate 21 and top substrate 31 where at least one substrate is transparent to the wavelengths of light to be detected. A wide variety of materials are available for selection as the substrates, for example fused quartz, glass, sapphire, or other materials amenable with the desired wavelengths and the fabrication steps to be described. In addition, the associated electronic circuitry already may already be fabricated on adjacent portions of the insulating substrates and may include thin film transistors (TFT) or CMOS/-SOS as well as biasing and associated signal processing circuitry.

Dynodes $22^1$, $22^2$, $22^3$, $22^4$, . . . $22^N$ are deposited and photolithographically patterned and etched in accordance with established techniques on the respective substrates 21 and 31. The last dynode $22^N$ also may be referred to as an anode $22^N$ and will function as the anode in this embodiment of the microelectronic photomultiplier device. The materials chosen for the dynodes may be doped polysilicon or other materials suitable for dynode fabrication. The photocathode material may be chosen to optimize the light collecting efficiency of microelectronic photomultiplier device 20 yet it need not be compatible with conventional microelectronic fabrication steps and devices due to the ensuing novel fabrication steps. This feature is significant since many of the photocathode materials are not compatible with standard silicon processing. In other words, for example, materials S-20, 24 and 25 in Table I contain sodium which is a mobile ion in silicon dioxide and is known to cause instability of oxide-passivated devices (e.g. MOSFETSs). Also listed in Table I are materials containing bismuth, antimony, gallium, indium and phosphorous which are all dopants to silicon.

Figures 5B, 5C, 5D:
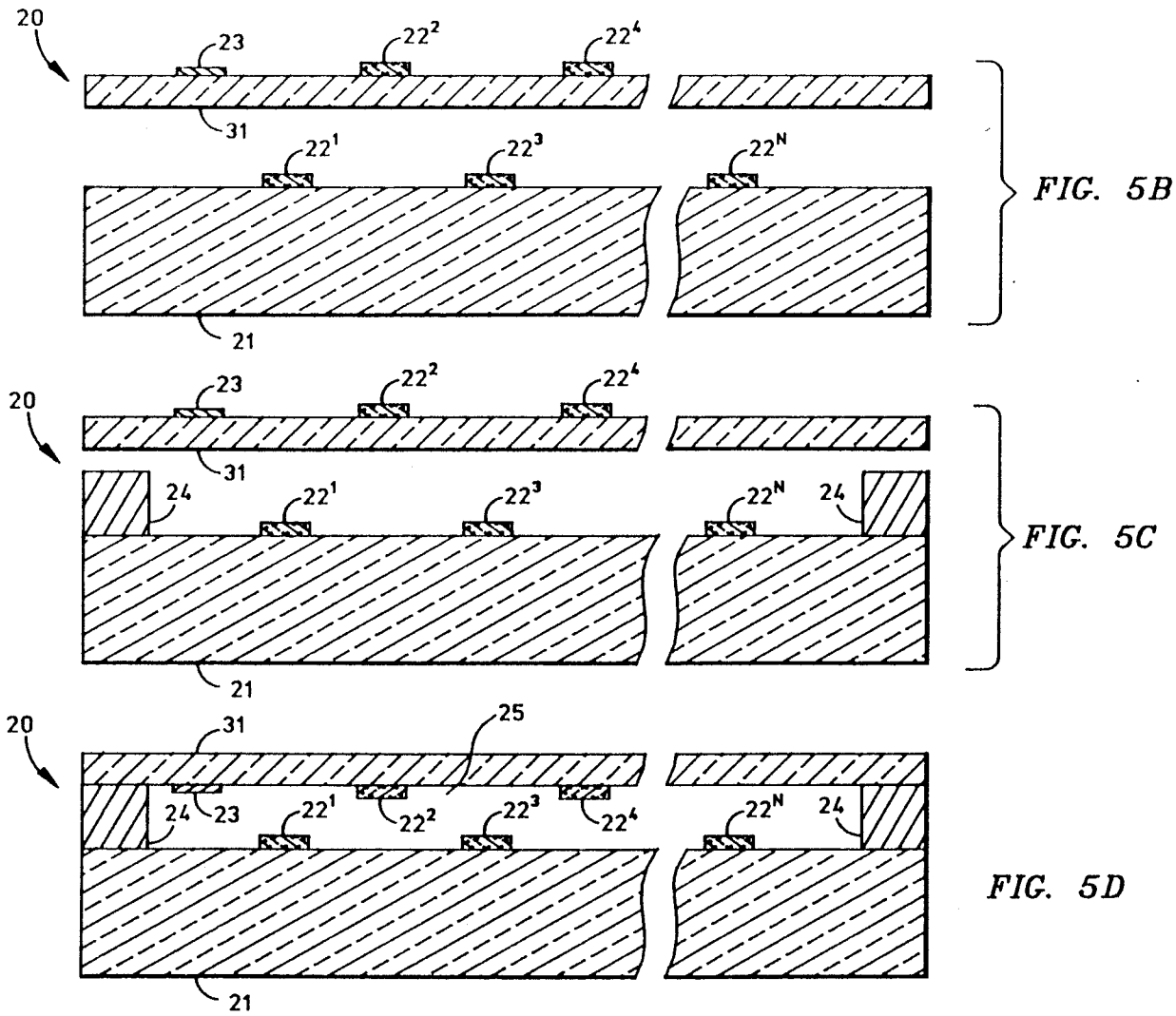

A photocathode 23 is appropriately deposited and photolithographically patterned and etched on insulating substrate 31, see FIG. 5B. The photocathode material may be chosen to optimize the light collecting efficiency of microelectronic photomultiplier device 20 yet it need not be compatible with conventional microelectronic fabrication steps and devices due to the ensuing novel fabrication process. Typical representative photocathode materials used in the prior art for photomultiplier tubes are listed in Table 1 and may be selected as applicable to the embodiments discussed herein.

TABLE 1

| | | Standard Photocathodes for photomultipliers and vacuum photodiodes, and their characteristics | | | | | | | |
|---|---|---|---|---|---|---|---|---|---|
| Spectral Response Designation | Photosensitive Material | Type of Sensor | Window Material | Mode* of Operation T or R | Wavelength of Maximum Response ($\lambda_{max}$) - nm | Typical Luminous Responsivity - $\mu A\ lm^{-1}$ | Typical Radiant Responsivity at $\lambda_{max}$ - $mA\ W^{-1}$ | Typical Quantum Efficiency at $\lambda_{mx}$ - % | Photocathode Dark Emission at 25° C. - $fA\ cm^{-2}$ |
| S-1 | Ag—O—Cs | Photoemitter | Lime Glass | T,R | 800 | 30 | 2.8 | 0.43 | 900 |

TABLE 1-continued

Standard Photocathodes for photomultipliers and vacuum photodiodes, and their characteristics

| Spectral Response Designation | Photosensitive Material | Type of Sensor | Window Material | Mode* of Operation T or R | Wavelength of Maximum Response ($\lambda_{max}$) - nm | Typical Luminous Responsivity - $\mu A\ lm^{-1}$ | Typical Radiant Responsivity at $\lambda_{max}$ - $mA\ W^{-1}$ | Typical Quantum Efficiency at $\lambda_{mx}$ - % | Photocathode Dark Emission at 25° C. - $fA\ cm^{-2}$ |
|---|---|---|---|---|---|---|---|---|---|
| S-3 | Ag—O—Rb | Photoemitter | Lime Glass | R | 420 | 6.5 | 1.8 | 0.53 — | |
| S-4 | Cs—Sb | Photoemitter | Lime Glass | R | 400 | 40 | 40 | 12.4 | 0.2 |
| S-5 | Cs—Sb | Photoemitter | 9741 Glass | R | 340 | 40 | 50 | 18.2 | 0.3 |
| S-8 | Cs—Bi | Photoemitter | Lime Glass | R | 365 | 3 | 2.3 | 0.78 | 0.13 |
| S-9 | Cs—Sb | Photoemitter | 7052 Glass | T | 480 | 30 | 20.5 | 5.3 | 0.3 |
| S-10 | Ag—Bi—O—Cs | Photoemitter | Lime Glass | T | 450 | 40 | 20 | 5.5 | 70 |
| S-11 | Cs—Sb | Photoemitter | Lime Glass | T | 440 | 70 | 56 | 15.7 | 3 |
| S-13 | Cs—Sb | Photoemitter | Fused Silica | T | 440 | 60 | 48 | 13.5 | 4 |
| S-14 | Ge | P-n Alloy Junction | Lime Glass | — | 1,500 | 12,400 | 52 | 43 | — |
| S-16 | CdSe | Polycrystalline Photoconductor | Lime Glass | — | 730 | — | — | — | — |
| S-17 | Cs—Sb | Photoemitter with Reflective Substrate | Lime Glass | R | 490 | 125 | 83 | 21 | 1.2 |
| S-19 | Cs—Sb | Photoemitter | Fused Silica | R | 330 | 40 | 65 | 24.4 | 0.3 |
| S-20 | Na—K—Cs—Sb | Photoemitter | Lime Glass | T | 420 | 150 | 64 | 18.8 | 0.3 |
| Not Standardized | Na—K—Cs—Sb | Photoemitter with Reflective Substrate | Lime Glass | R | 530 | 300 | 89 | 20.8 | — |
| | Na—K—Cs—Sb (ERMA III) | Photoemitter | 7740 Pyrex | T | 565 | 230 | 45 | 10 | 1.4 |
| S-21 | Cs—Sb | Photoemitter | 9741 Glass | T | 440 | 30 | 23.5 | 6.6 | 4 |
| S-23 | Rb—Te | Photoemitter | Fused Silica | T | 240 | — | 4 | 2 | 0.001 |
| S-24 | K—Na—Sb | Photoemitter | 7056 Glass | T | 380 | 45 | 67 | 21.8 | 0.0003 |
| S-25 | Na—K—Cs—Sb | Photoemitter | Lime Glass | T | 420 | 200 | 43 | 12.7 | 1 — |
| Not standardized | K—Cs—Sb | Photoemitter | Lime Glass | T | 380 | 85 | 97 | 31 | 0.02 |
| | K—Ca—Sb | Photoemitter | Lime Glass | R | 400 | 65 | 54 | 17 | — |
| | Cs—Te | Photoemitter | Fused Silica | T | 250 | — | 15 | 7.4 | — |
| Not Standardized | Ga—As | Photoemitter | 9741 Glass | R | 830 | 300 | 68 | 10 | 0.1 |
| | Ga—As—P | Photoemitter | 9741 Glass | R | 400 | 160 | 45 | 14 | 0.01 |
| | Ga—In—As | Photoemitter | 9741 Glass | R | 400 | 100 | 57 | 17.6 | — |
| | Cd—S | Polycrystalline Photoconductor | Lime Glass | — | 510 | — | — | — | — |
| | Cd(S—Se) | Polycrystalline Photoconductor | Lime Glass | — | 615 | — | — | — | — |
| | Si | N-on-p Photo- | No Window | — | 860 | 7,650 | 580 | 83.5 | — |

TABLE 1-continued

| Spectral Response Designation | Photosensitive Material | Type of Sensor | Window Material | Mode* of Operation T or R | Wavelength of Maximum Response ($\lambda_{max}$) - nm | Typical Luminous Responsivity - $\mu A\ lm^{-1}$ | Typical Radiant Responsivity at $\lambda_{max}$ - $mA\ W^{-1}$ | Typical Quantum Efficiency at $\lambda_{mx}$ - % | Photocathode Dark Emission at 25° C. - $fA\ cm^{-2}$ |
|---|---|---|---|---|---|---|---|---|---|
| | | Standard Photocathodes for photomultipliers and vacuum photodiodes, and their characteristics | | | | | | | |
| | Si | voltaic P-i-n Photoconductor | Lime Glass | — | 900# | 620# | 620# | 85# | — |

*T = Transmission Mode
R = Reflection Mode
Photovoltaic short-circuit responsivity
#For a wafer thickness of approximately 150 μm Noting FIG. 5C, spacers 24 are fixed to the bottom substrate 21 via any one of a number of methods of affixation. One possible way this may be accomplished is by masking bottom substrate 21 and its integrated dynodes $22^1, 22^3, \ldots 22^N$ and the deposition, photolithographic patterning and etching of the appropriately located spacers 24. Two materials which are suitable for the formation of the spacers are polysilicon and silicon dioxide, but others may be utilized as will be apparent to those skilled in the art to which this invention pertains. An alternative technique for forming spacer 24 is consistent with the practices used in fabricating liquid crystal displays. The alternative technique relies on the affixing of spacers 24 to bottom substrate 21 using an epoxy or other suitable bonding agent. The spacer is appropriately dimensioned to assure the separation between adjacent staggered dynodes and anode as being between 1 micron and 10 millimeters.

Referring to FIG. 5D, top transparent insulating substrate 31 is aligned adjacent with respect to the bottom substrate 21 so that its integrated photocathode 23 and dynodes $22^2, 22^4, \ldots$ are arranged in an alternating staggered pattern with respect to the integrated dynodes $22^1, 22^3, \ldots 22^N$ on lower insulating substrate 21. Thusly aligned, the substrates are placed in a vacuum chamber and a vacuum is introduced to vacuumize a chamber 25 formed between the upper and lower insulating substrates and the spacers. The top substrate is affixed onto the spacer 24 using an epoxy, metallic eutectic for diffusion bonding or other suitable bonding agent. Alternately, a wafer bonding technique can be chosen, in which case, the substrates and the spacers are appropriately matched materials, such as silicon-silicon dioxide, silicon dioxide-silicon dioxide, silicon-sapphire that are joined together by placing clean, flat surfaces of the substrates and the spacers in intimate contact. This intimate contact of the suitable materials allows van der Walls forces to adjoin the surfaces providing a permanent fusing of the two substrates via the spacers. A subsequent heat treatment may be desired to increase the bond strength according to established practices in the art.

Figure 5E:
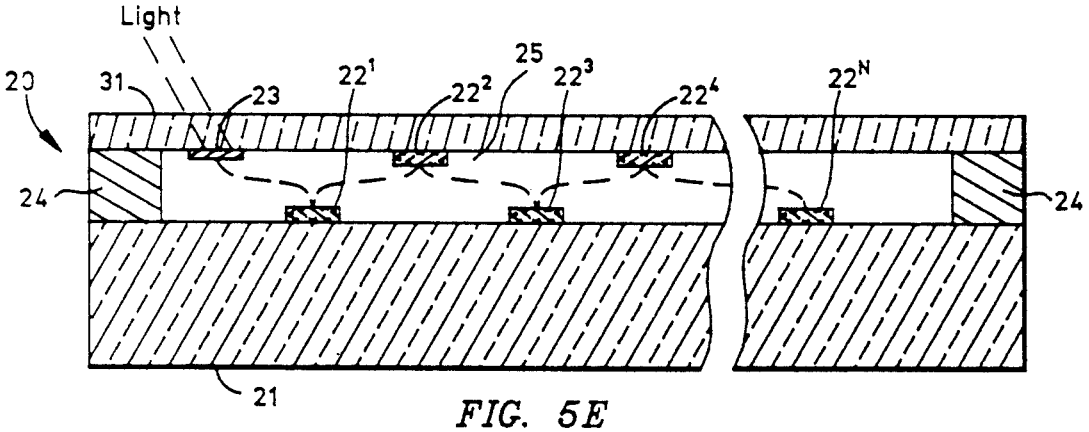

Irrespective which assembly technique is selected, an advantage of affixing the two substrates together under a vacuum is the consequent formation of an evacuated or a vacuum chamber 25 which is suitable for electron transport, such as schematically depicted in FIG. 5E. The finished microelectronic photomultiplier device 20 shows the light impinging on photocathode 23 with subsequent electron transport and amplification through vacuum chamber 25 along the dynode chain $22^1, 22^2, \ldots 22^N$ (to an anode $22^N$). The photocathode, dynodes and anode are suitably interconnected to appropriate biasing and utilization components in accordance with practices well established in the art.

The optimum thicknesses for photocathode 23 and dynodes $22^1 \ldots 22^N$ will depend upon the material used and upon the desired detection wavelength but shall be in the range from 1 nm to less than or to 500 microns. Their lengths (measured in the direction of current flow between cathode and anode) will be in the range from 1 micron to about 10 millimeters. Their widths (measured in the direction perpendicular to current flow between cathode and anode) shall be more than twice their lengths. The spacing between an adjacent photocathode, dynodes and/or anode is in the range of from 1 micron to about 10 millimeters.

Further optimized designs for specific applications including additional focusing electrodes, symetrical or asymmetrical dynode configurations to improve quantum efficiency, to optimize high gain or high speed are readily accommodated within the scope of this inventive concept. Obviously, many modifications and variations of the present invention are possible in the light of the above teachings. It is therefore to be understood that within the scope of the appended claims, the invention may be practiced otherwise than as specifically described.

We claim:

1. A method of fabricating a microelectronic photomultiplier device with an integrated circuitry responsive to an external at least one impinging wavelength:

providing a transparent insulating substrate being adapted to provide compatible associated integrated circuitry to optionally allow logic, control and power circuitry to be integrated with the microelectronic photomultiplier device;

depositing substantially planar dynodes and one substantially planar anode in a juxtaposed arrangement on said transparent insulating substrate;

depositing a substantially planar photocathode adjacent said substantially planar dynodes on said transparent insulating substrate, said substantially planar photocathode having the property to generate a representative electron emission in response to said at least one impinging wavelength;

depositing a volume of sacrificial material sufficient to cover said substantially planar dynodes, said substantially planar anode and said substantially planar photocathode;

depositing a polysilicon cap over the sacrificial material volume;

providing a hole through said polysilicon cap to be in communication with the sacrificial material volume;

introducing an etchant having the property to etch-away said sacrificial material and further having the property not to etch away the materials of said polysilicon cap, said substantially planar dynodes, said substantially planar anode and said substantially planar photocathode;

etching-away said sacrificial material volume to produce a cavity inside said polysilicon cap containing said substantially planar dynodes, said substantially planar anode and said substantially planar photocathode;

evacuating any gas that may have been in said cavity to produce an evacuated cavity; and sealing said hole in said polysilicon cap in a vacuum thereby forming an evacuated cavity-chamber in said polysilicon cap containing said substantially planar dynodes, said substantially planar anode and said substantially planar photocathode to thereby provide said microelectronic photomultiplier device.

2. A method according to claim 1 in which said sealing includes placing of said transparent insulating substrate said polysilicon cap, said substantially planar photocathode, said substantially planar dynodes and said substantially planar anode in a vacuum chamber, applying a vacuum thereto to create said evacuated cavity, and applying laser light in sufficient fluence to melt the polysilicon cap to effect a reflow and resolidification of the cap to enclose the opening to form said cavity-chamber.

3. A method according to claim 1 in which said sacrificial material is silicon dioxide and said etchant is hydrofluoric acid.

4. A method according to claim 2 in which said fluence exceeds 0.5 $J/cm^2$ with a 25 nsec pulse.

5. A method of fabricating a microelectronic photomultiplier device with an integrated circuitry responsive to at least one impinging wavelength comprising:

providing two insulating substrates, at least one of which being transparent to said at least one impinging wavelength said insulating substrates being planar and parallel with respect to one another and being adapted to provide compatible associated integrated circuitry to optionally allow logic, control and power circuitry to be integrated with the microelectronic photomultiplier device;

depositing substantially planar dynodes on each of said insulating substrates to have a staggered alternating pattern of parallel said substantially planar dynodes therebetween and one adjacent substantially planar anode disposed on one of said insulating substrates;

depositing a substantially planar photocathode on one of said insulating substrates adjacent said substantially planar dynodes on one of said insulating substrates, said substantially planar photocathode having the property to generate a representative electron emission in response to said at least one impinging wavelength;

forming a spacer between said insulating substrates to have a peripherally encircling definition about the deposited said substantially planar dynodes, said substantially planar anode and said substantially planar photocathode to define a chamber therein;

evacuating any gas that may have been in said chamber to produce a vacuum chamber; and affixing said spacer to said insulating substrates to define said vacuum chamber therein containing said substantially planar dynodes, said substantially planar anode and said substantially planar photocathode to thereby provide said microelectronic photomultiplier device.

6. A method according to claim 5 in which said forming includes the deposition of said spacer on at least one of said insulating substrates and patterning and etching to have a peripheral definition about the deposited said substantially planar dynodes, said substantially planar anode and said substantially planar photocathode on said insulating substrates.

7. A method according to claim 5 in which said affixing includes placing of said insulating substrates including said polysilicon cap, said substantially planar dynodes, said substantially planar anode and said substantially planar photocathode in said chamber and applying a vacuum thereto to create said vacuum chamber, and adjoining said insulating substrates using wafer bonding techniques.

* * * * *